US009759148B2

(12) United States Patent
Jammoussi et al.

(10) Patent No.: US 9,759,148 B2
(45) Date of Patent: Sep. 12, 2017

(54) METHOD AND SYSTEM FOR DETERMINING AIR-FUEL RATIO IMBALANCE VIA ENGINE TORQUE

(71) Applicant: Ford Global Technologies, LLC, Dearborn, MI (US)

(72) Inventors: Hassene Jammoussi, Canton, MI (US); Imad Hassan Makki, Dearborn Heights, MI (US); Michael Igor Kluzner, Oak Park, MI (US); Robert Roy Jentz, Westland, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 222 days.

(21) Appl. No.: 14/712,202

(22) Filed: May 14, 2015

(65) Prior Publication Data

US 2016/0333809 A1 Nov. 17, 2016

(51) Int. Cl.

| | |
|---|---|
| ***F02D 41/12*** | (2006.01) |
| ***F02D 41/14*** | (2006.01) |
| ***F02D 41/00*** | (2006.01) |
| ***F02D 41/24*** | (2006.01) |
| *F02D 41/02* | (2006.01) |

(52) U.S. Cl.

CPC ..... *F02D 41/123* (2013.01); *F02D 41/0085* (2013.01); *F02D 41/1454* (2013.01); *F02D 41/1497* (2013.01); *F02D 41/247* (2013.01); *F02D 41/023* (2013.01); *F02D 41/0215* (2013.01); *F02D 41/0225* (2013.01); *F02D 2200/1002* (2013.01); *F02D 2200/1012* (2013.01); *F02D 2200/50* (2013.01); *F02D 2200/501* (2013.01); *F02D 2200/602* (2013.01); *F02D 2200/702* (2013.01); *F02D 2250/18* (2013.01)

(58) Field of Classification Search

CPC .. F02D 41/123; F02D 41/247; F02D 41/1454; F02D 41/1497; F02D 41/0085; F02D 41/0225; F02D 41/0215; F02D 2250/18; F02D 2200/1002; F02D 41/023; F02D 2200/50; F02D 2200/501; F02D 2200/602

See application file for complete search history.

(56) References Cited

U.S. PATENT DOCUMENTS 6,189,316 B1 * 2/2001 Surnilla ..... F01N 3/0842 123/443
6,244,043 B1 * 6/2001 Farmer ..... B01D 53/9454 60/274

(Continued)

OTHER PUBLICATIONS

Jammoussi, H. et al., "Method and System for Determining Air-Fuel Ratio Imbalance," U.S. Appl. No. 14/641,073, filed Mar. 6, 2015, 64 pages.

*Primary Examiner* — Joseph Dallo

(74) *Attorney, Agent, or Firm* — Julia Voutyras; McCoy Russell LLP

(57) ABSTRACT

Methods and systems are presented for assessing the presence or absence of engine torque deviation which may indicate air-fuel ratio imbalance between engine cylinders. In one example, the method may include assessing the presence or absence of engine torque variation based on engine torque deviation from a desired engine torque during a deceleration fuel shut-off event.

17 Claims, 10 Drawing Sheets

(56) References Cited

U.S. PATENT DOCUMENTS

| | | | | |
|---|---|---|---|---|
| 7,028,670 | B2 * | 4/2006 | Doering | F01N 3/0814 123/198 F |
| 7,181,905 | B2 * | 2/2007 | Surnilla | F02D 41/0235 123/481 |
| 2008/0243362 | A1 * | 10/2008 | Mitsuda | F02D 13/06 701/103 |
| 2011/0166795 | A1 * | 7/2011 | Ohshima | F02D 41/0072 702/22 |
| 2012/0060794 | A1 | 3/2012 | Born et al. | |
| 2014/0202426 | A1 * | 7/2014 | Surnilla | F02D 17/02 123/349 |
| 2014/0290622 | A1 * | 10/2014 | Ikeda | F02D 41/0085 123/344 |
| 2016/0258375 | A1 * | 9/2016 | Jammoussi | F02D 41/1475 |
| 2016/0258376 | A1 * | 9/2016 | Jammoussi | F02D 41/123 |

* cited by examiner

METHOD AND SYSTEM FOR DETERMINING AIR-FUEL RATIO IMBALANCE VIA ENGINE TORQUE

FIELD

The present description relates generally to methods and systems for controlling a vehicle engine to monitor an air-fuel ratio imbalance during decelerated fuel shut-off (DFSO).

BACKGROUND/SUMMARY

Engine exhaust gases may be highly correlated with engine air-fuel ratio. For example, combustion of richer air-fuel mixtures in an engine may lead to higher HC and CO emissions while leaner mixtures may lead to higher NOx emissions. Engine exhaust gases may be directed to a catalyst where they are processed into more desirable compounds such as $H_2O$ and $CO_2$. However, if engine exhaust gases are not rich or lean as expected due to engine air-fuel ratio variation between an engine's cylinders, engine emissions may degrade.

One way to determine and correct air-fuel ratio variation between engine cylinders is to sense engine exhaust gases via an oxygen sensor. However, the oxygen sensor may be exposed to exhaust gases that are a combination of gases from different engine cylinders. Therefore, it may be difficult to accurately determine air-fuel variations between different engine cylinders. Further, engine exhaust system geometry for cylinders having a large number of cylinders may bias sensor readings toward output of one cylinder more than other cylinders. Consequently, it may be even more difficult to determine air-fuel imbalance for engines having more than a few cylinders.

The inventors herein have recognized the above-mentioned limitations and have developed a method for detecting cylinder air-fuel imbalance that is not subject to exhaust system geometry and that may signal to noise ratio for determining cylinder to cylinder air-fuel imbalance. The method comprises: during a deceleration fuel shut-off (DFSO) event where all cylinders of an engine are deactivated, selectively sequentially combusting air and fuel in cylinders of a cylinder group in the engine, each cylinder fueled via a fuel pulse width, and adjusting fuel injected to one or more cylinders in the cylinder group in response to variation of engine torque from an expected engine torque during the DFSO event.

By selectively activating cylinders during DFSO and determining engine torque, it may be possible to provide the technical result of improving cylinder to cylinder air-fuel ratio imbalance detection and correction. For example, torque produced via a cylinder may be inferred from engine acceleration at a time when other engine cylinders are deactivated so that torque output from one cylinder is not intermingled with torque produced via a cylinder adjacent to the one cylinder in a combustion order of the engine. In this way, an estimate of torque produced by the cylinder may be improved as compared to if engine torque were determined in the presence of other activated cylinders. The improved engine torque estimate may be compared to an expected engine torque estimate to determine an air-fuel correction factor for adjusting the cylinder's air-fuel ratio. Thus, it may be possible to correct an engine's cylinder to cylinder air-fuel ratio variation without the engine's exhaust system geometry biasing cylinder to cylinder air-fuel ratio imbalance estimates. Further, by determining torque of an activated cylinder when adjacent cylinders in the engine's firing order are deactivated, it may be possible to improve an estimate of torque produced by a cylinder which is a basis for determining cylinder air-fuel variation.

The present description may provide several advantages. For example, the approach may improve cylinder to cylinder air-fuel imbalance estimation for engines having oxygen sensor placement that may be influenced by cylinder air-fuel observations. Further, the approach may provide an improved signal to noise ratio of air-fuel variation for engines having greater numbers of cylinders by preventing combustion in cylinders that are adjacent to a cylinder being evaluated for torque production. Further still, the approach may be provided during engine operating conditions where the approach is less likely to be sensed via a vehicle operator.

The above discussion includes recognitions made by the inventors and not admitted to be generally known. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
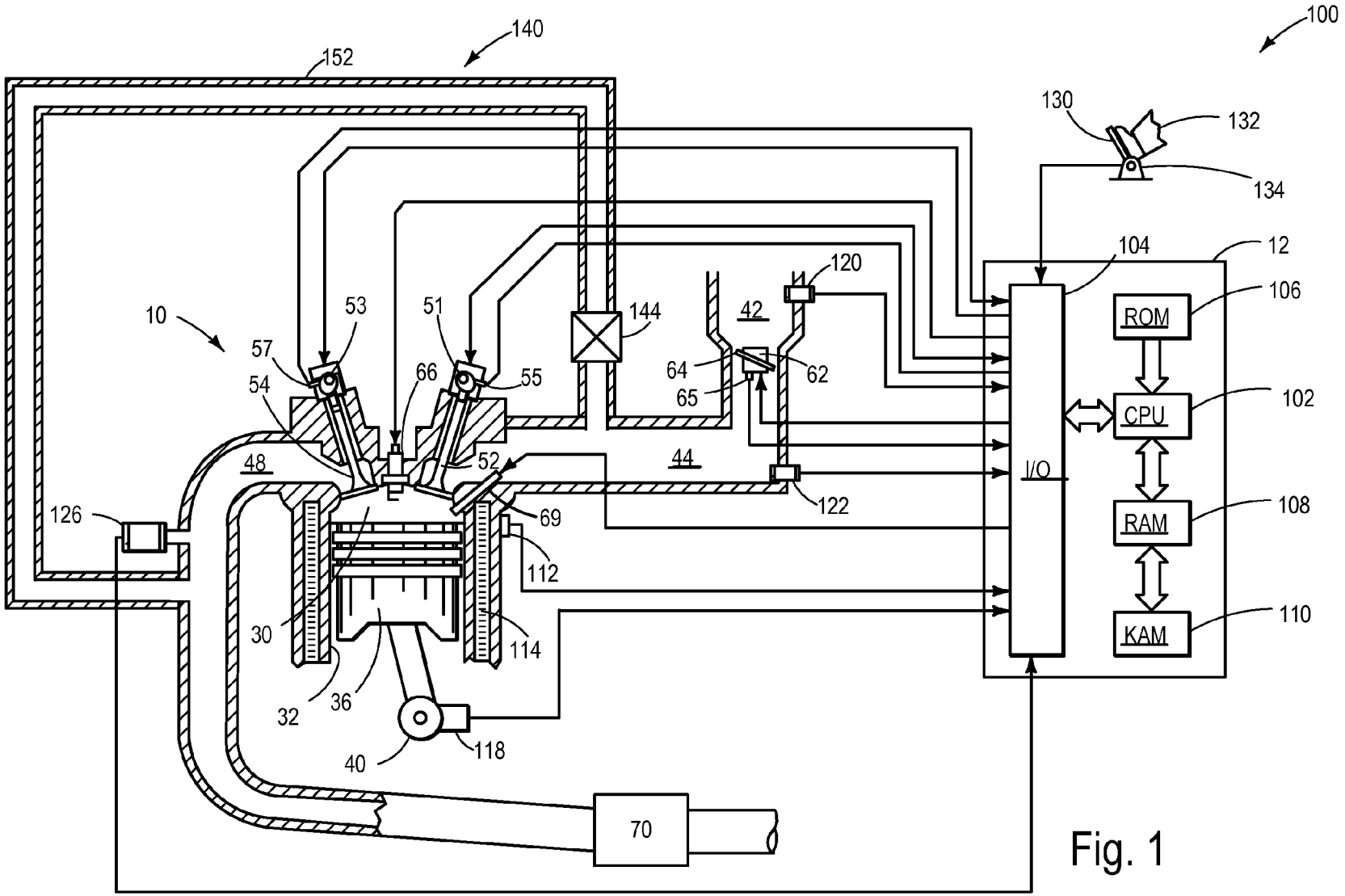
FIG. 1 is a schematic of an engine with a cylinder.
Figure 2:
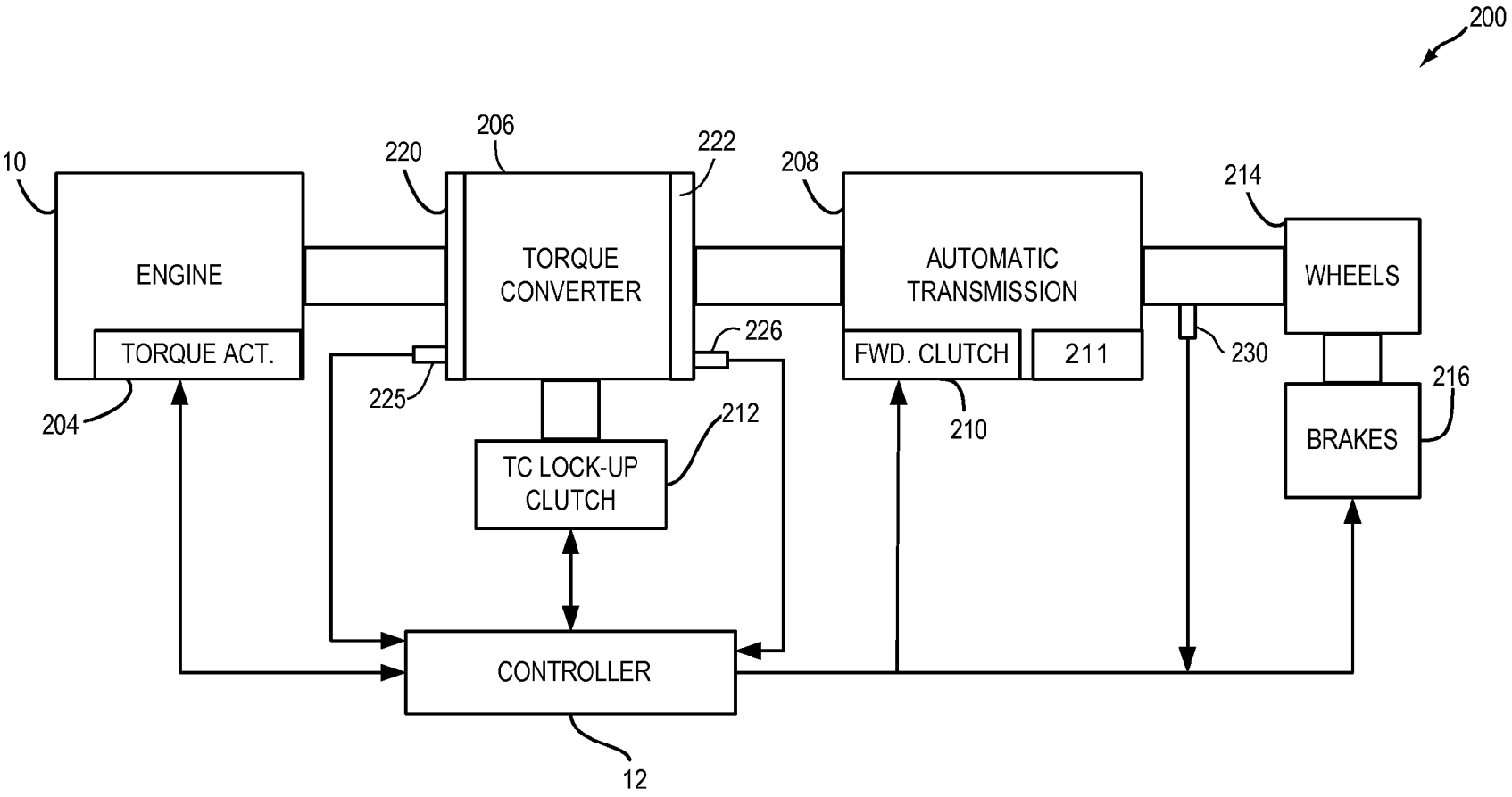
FIG. 2 is a schematic of a vehicle driveline including an engine and transmission.
Figure 3:
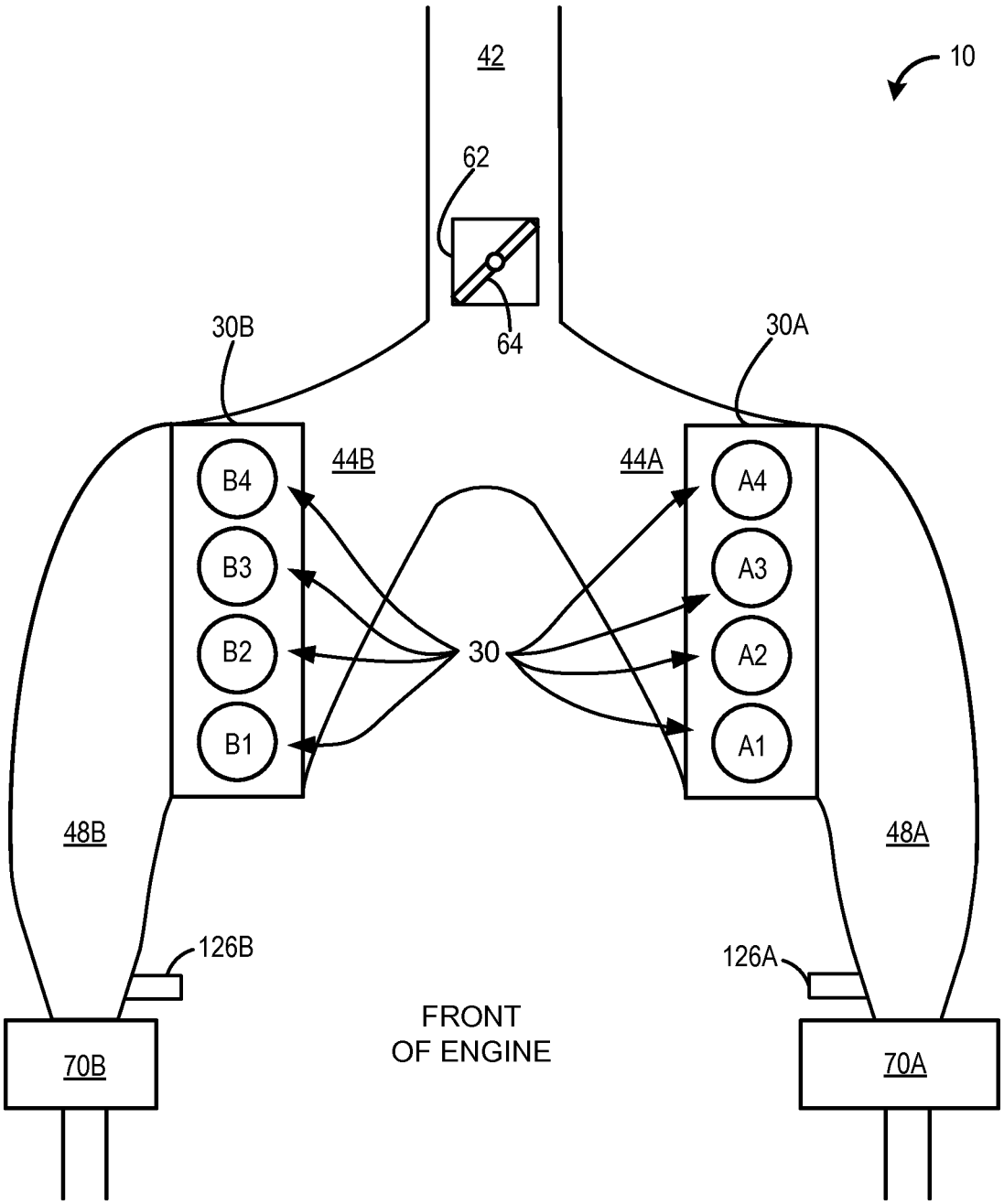
FIG. 3 is a schematic of an example V-8 engine with two cylinder banks.
Figure 4:
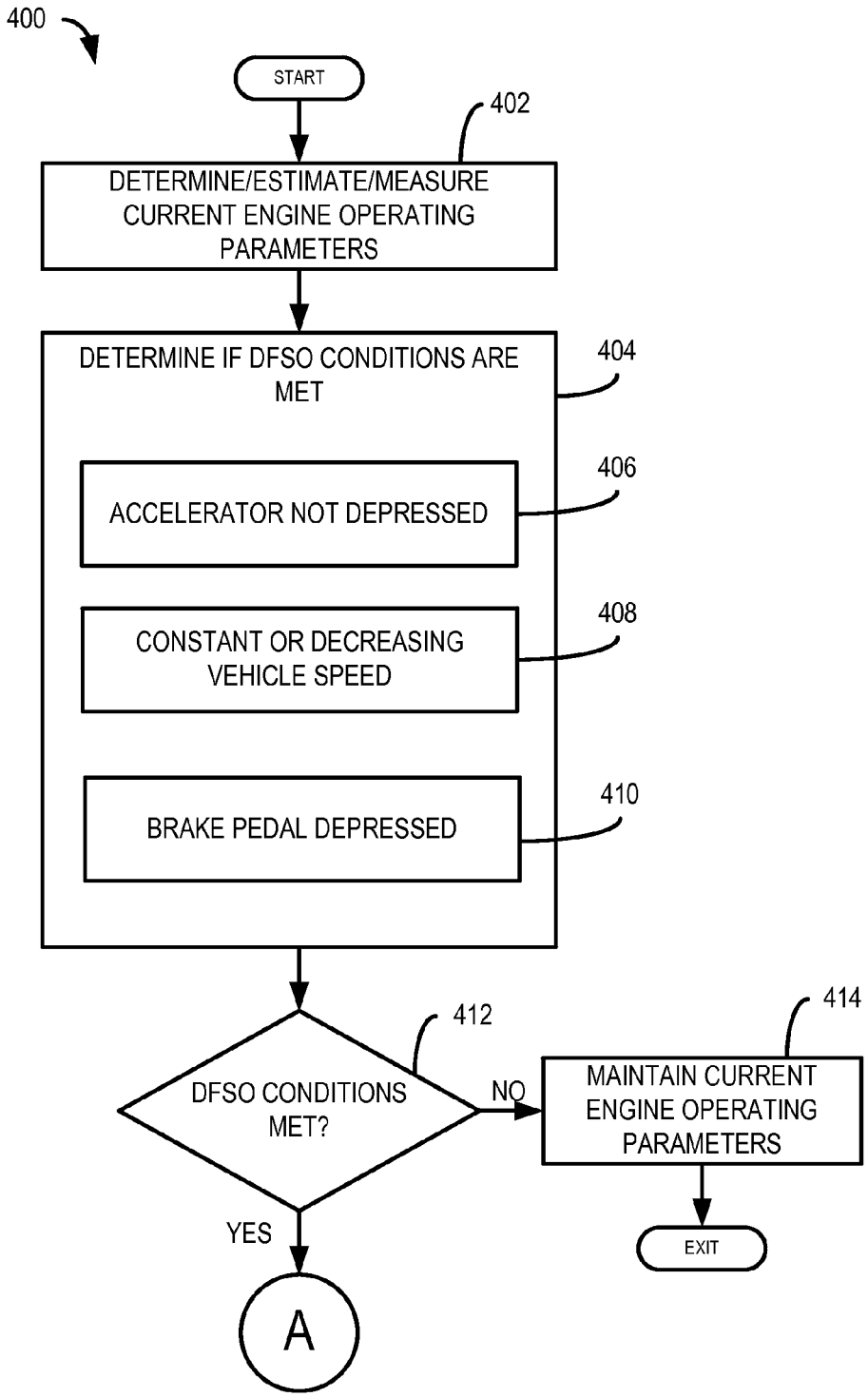
FIG. 4 is a flowchart of a method for determining conditions for DFSO.
Figure 5:
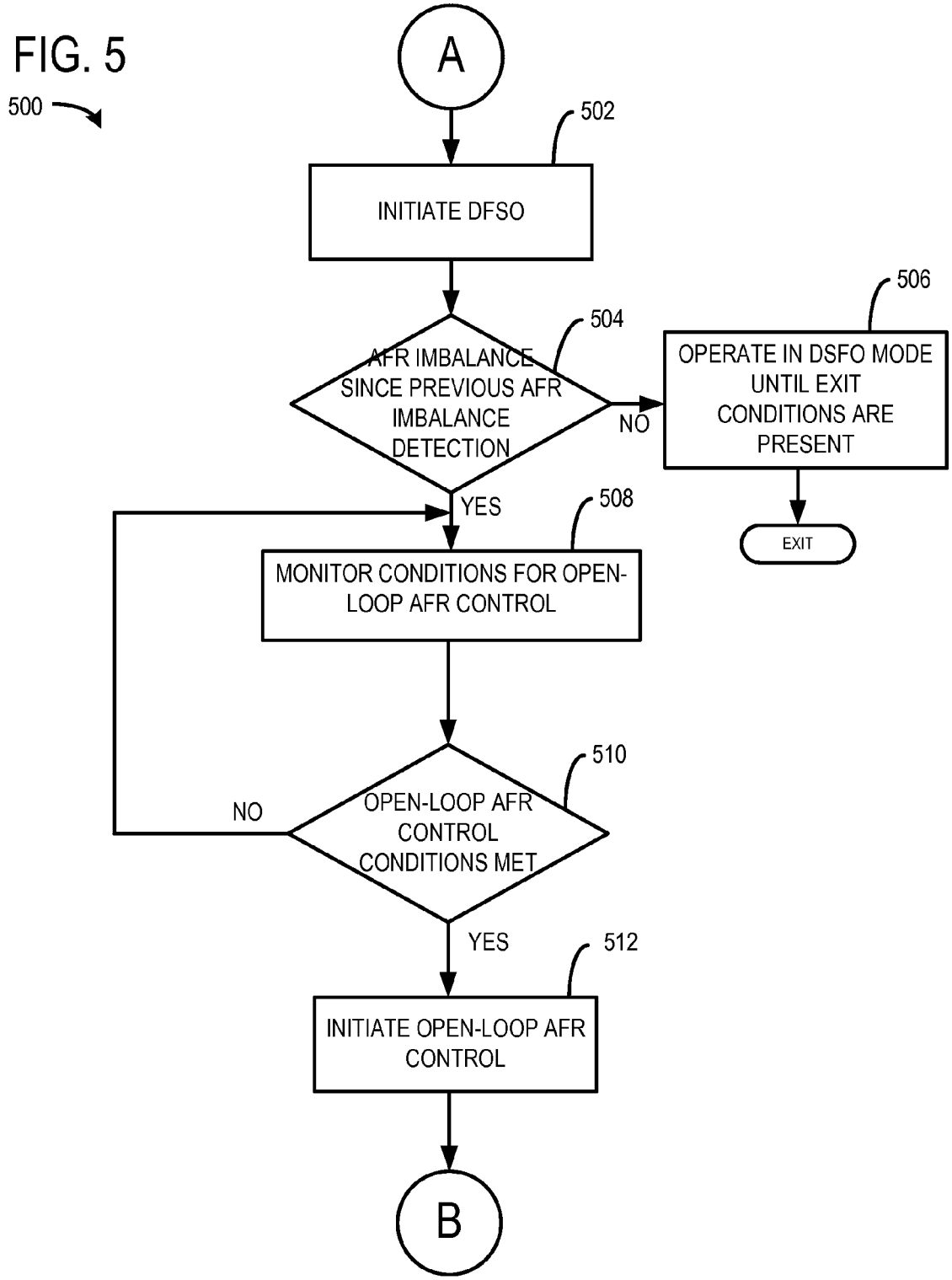
FIG. 5 is a flowchart of a method for determining conditions and initiation of torque based cylinder to cylinder air-fuel variation correction.
Figure 6:
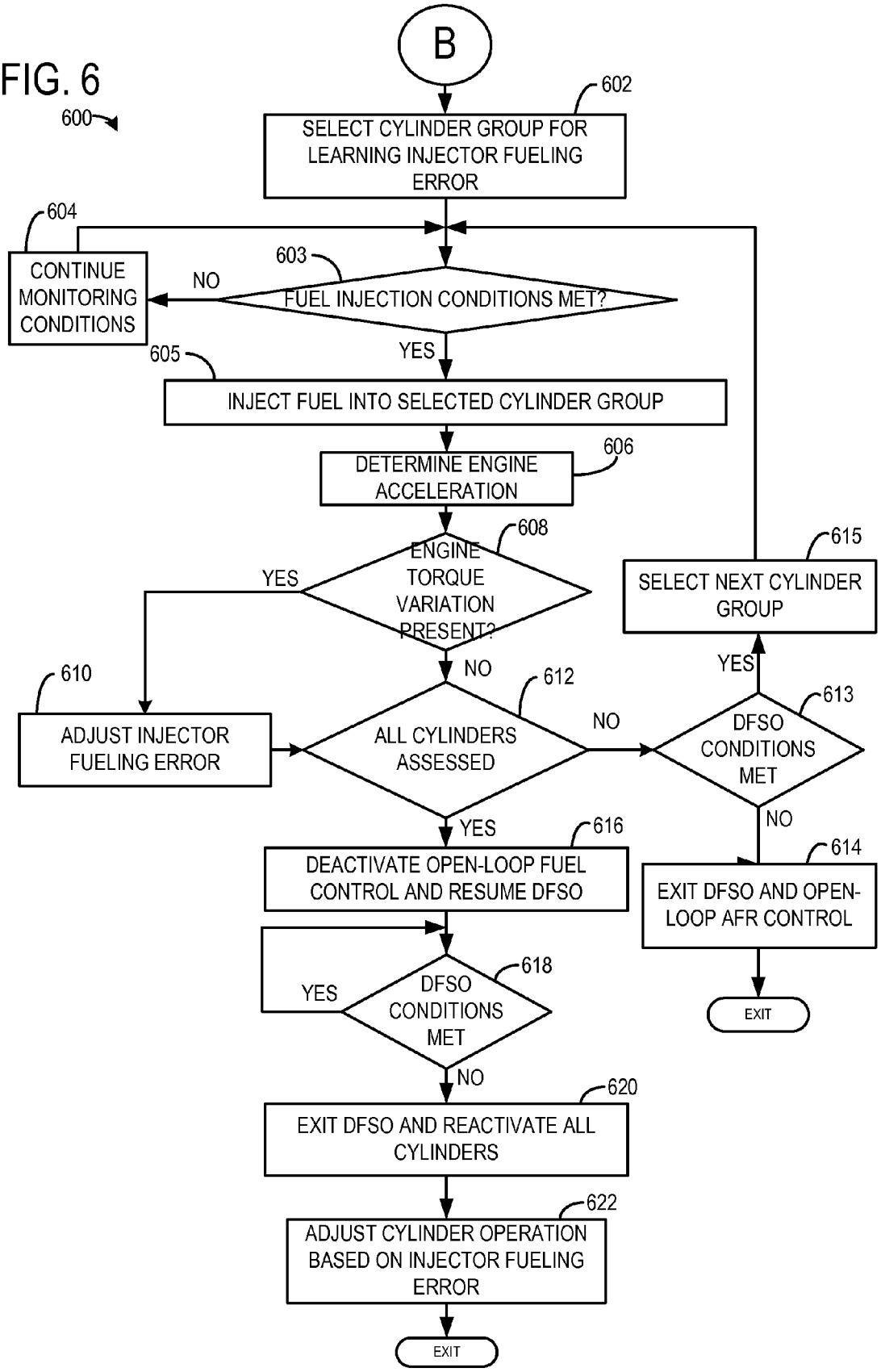
FIG. 6 is a flowchart of a method for firing selected cylinder groups during open-loop air-fuel ratio control for torque based cylinder to cylinder air-fuel variation correction.
Figure 7:
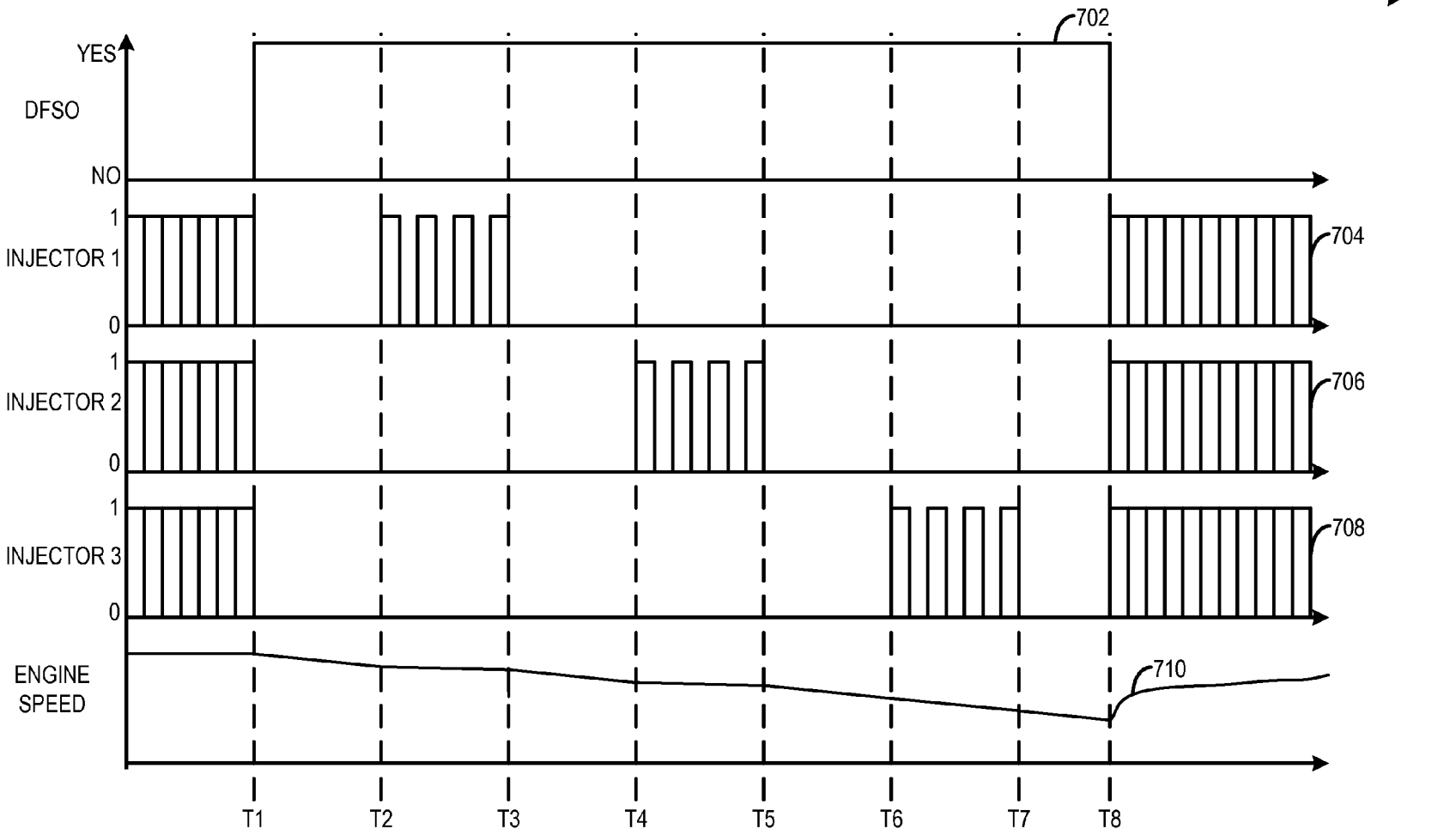
FIG. 7 is a plot of a sequence where torque based cylinder to cylinder air-fuel variation correction is applied with open-loop air-fuel ratio control during DFSO.
Figure 8:
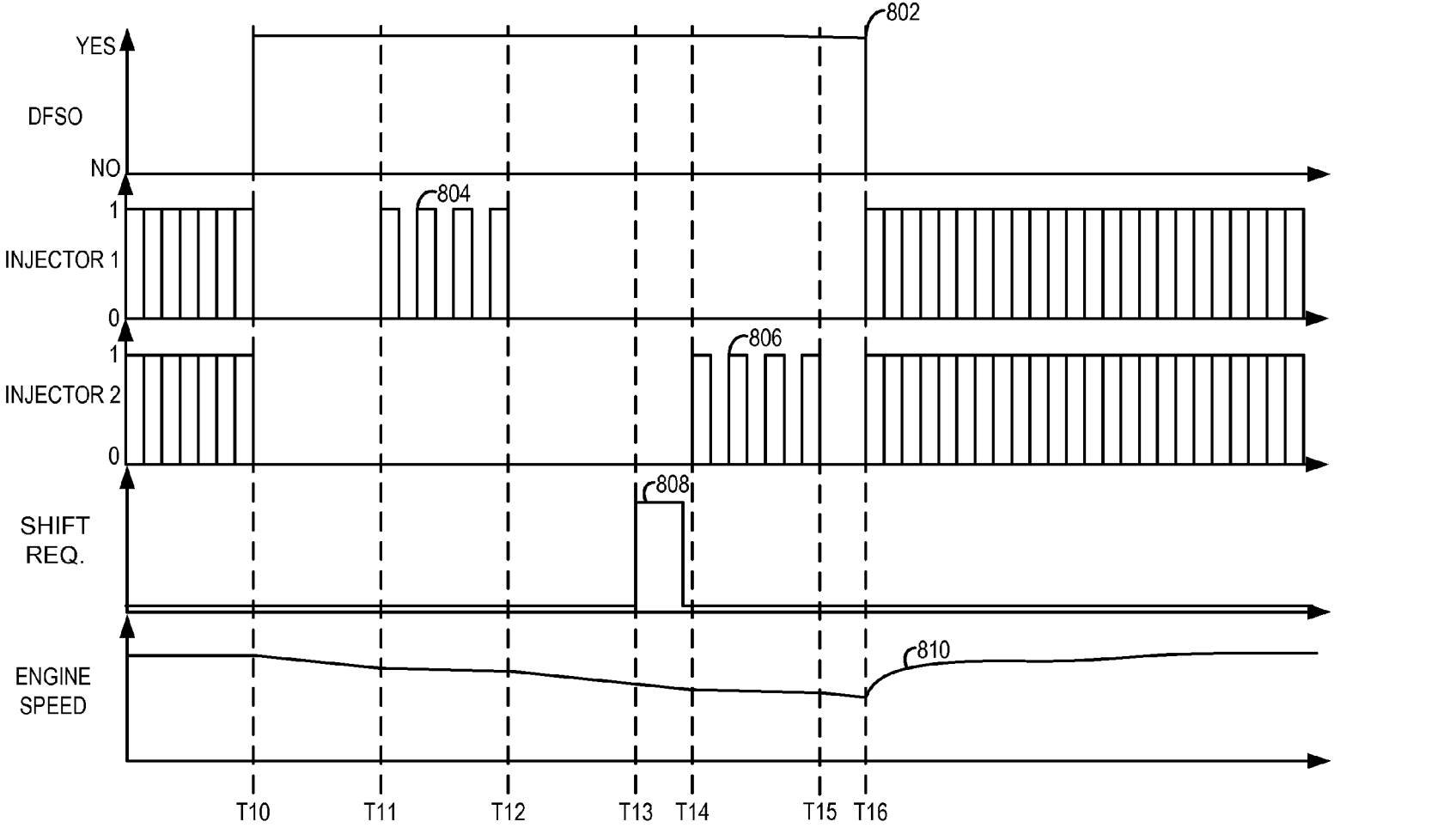
FIG. 8 is a plot of an example DFSO sequence where torque based cylinder to cylinder air-fuel variation correction is delayed in response to a transmission shift request.
Figure 9:
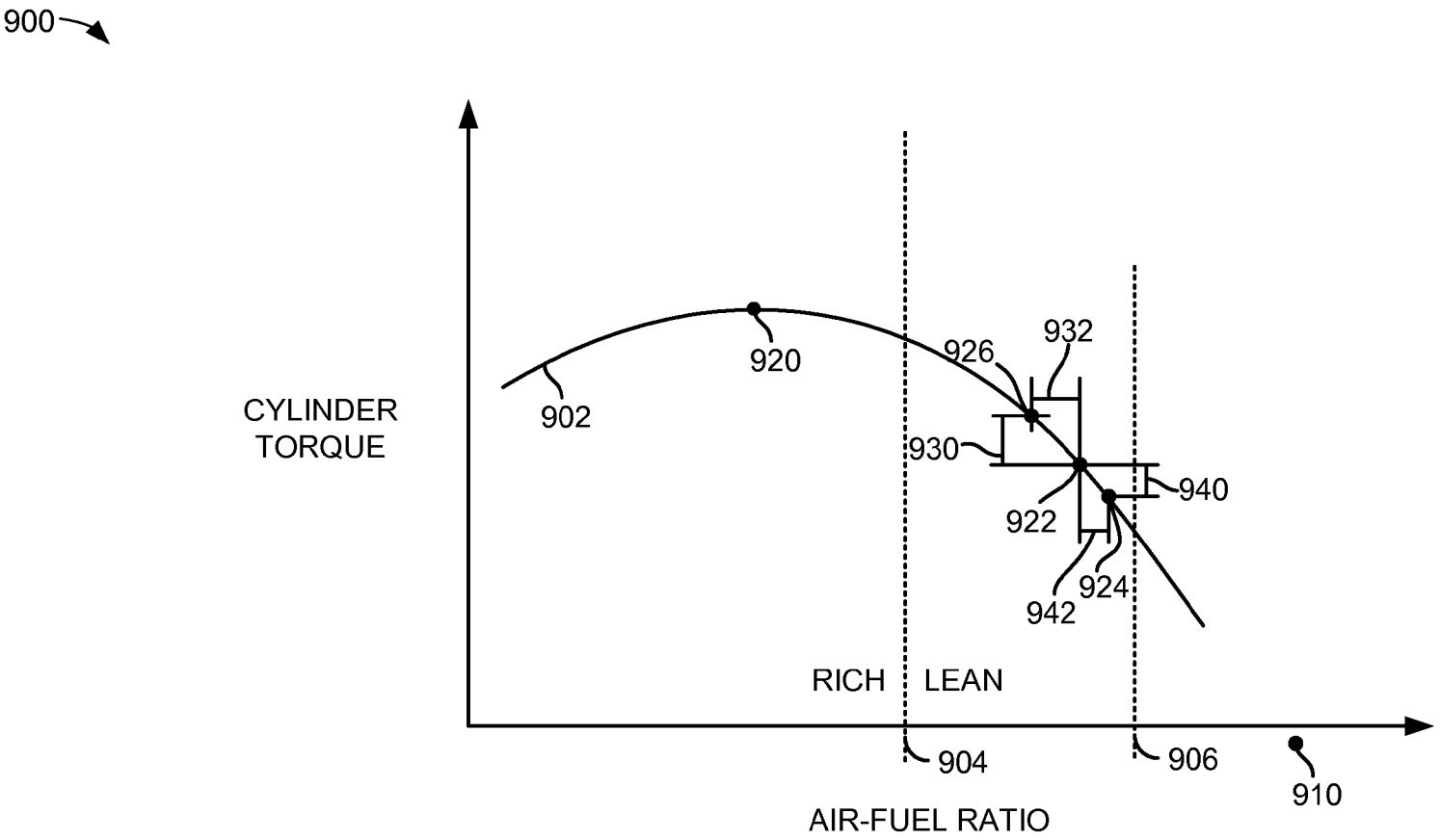
FIG. 9 is plot of showing how a cylinder torque estimate may be a basis for correcting cylinder to cylinder air-fuel variation.
Figure 10:
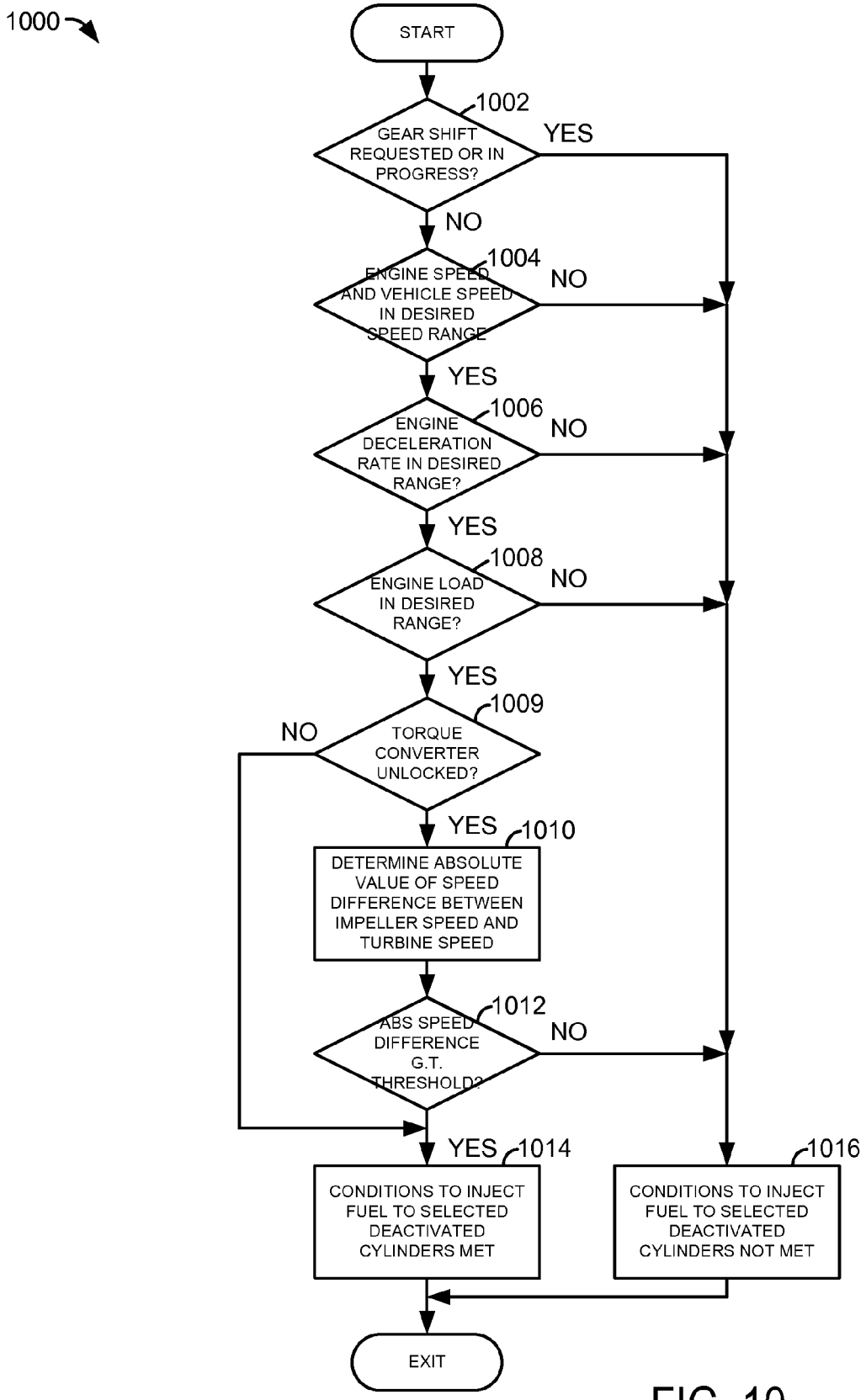
FIG. 10 is a flowchart of a method for determining if fuel injection is to be activated in selected cylinders to determine cylinder air-fuel ratio imbalance.

The following description relates to systems and methods for detecting and correcting an air-fuel ratio imbalance (e.g., variations between air-fuel ratios of engine cylinders) during DFSO. FIG. 1 illustrates a single cylinder of an engine comprising an exhaust gas sensor upstream of an emission control device. FIG. 2 depicts an engine, transmission, and other vehicle components. FIG. 3 shows an example V-8 engine with two cylinder banks, two exhaust manifolds, and two exhaust gas sensors. FIG. 4 shows a method for determining conditions for DFSO. FIG. 5 illustrates a method for initiating open-loop air-fuel ratio control during DFSO. FIG. 6 illustrates an exemplary method for carrying out the open-loop air-fuel ratio control and torque based cylinder to cylinder air-fuel ratio correction. FIG. 7 shows a plot of various signals of interest during open-loop air-fuel ratio control while determining the presence or absence of cylinder to cylinder air-fuel variation. FIG. 8 shows a sequence where torque based cylinder to cylinder air-fuel variation correction is delayed in response to a transmission shift request. A cylinder's torque curve is shown in FIG. 9 to illustrate how cylinder air-fuel ratio variation may be corrected based on cylinder torque. FIG. 10 shows vehicle operating conditions for determining whether or not to inject fuel to selected deactivated cylinders for the purpose of determining and correcting cylinder to cylinder air-fuel variation based on cylinder torque Referring now to FIG. 1, a schematic diagram showing one cylinder of a multi-cylinder engine 10 in an engine system 100 is shown. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal. A combustion chamber 30 of the engine 10 may include a cylinder formed by cylinder walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle via an intermediate transmission system. Further, a starter motor may be coupled to the crankshaft 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some examples, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative examples, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

A fuel injector 69 is shown coupled directly to combustion chamber 30 for injecting fuel directly therein in proportion to the pulse width of a signal received from the controller 12. In this manner, the fuel injector 69 provides what is known as direct injection of fuel into the combustion chamber 30. The fuel injector may be mounted in the side of the combustion chamber or in the top of the combustion chamber, for example. Fuel may be delivered to the fuel injector 69 by a fuel system (not shown) including a fuel tank, a fuel pump, and a fuel rail. In some examples, the combustion chamber 30 may alternatively or additionally include a fuel injector arranged in the intake manifold 44 in a configuration that provides what is known as port injection of fuel into the intake port upstream of the combustion chamber 30.

Spark is provided to combustion chamber 30 via spark plug 66. The ignition system may further comprise an ignition coil (not shown) for increasing voltage supplied to spark plug 66. In other examples, such as a diesel, spark plug 66 may be omitted.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal. The intake passage 42 may include a mass air flow sensor 120 and a manifold air pressure sensor 122 for sensing an amount of air entering engine 10.

An exhaust gas sensor 126 is shown coupled to the exhaust passage 48 upstream of an emission control device 70 according to a direction of exhaust flow. The sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 126 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 70 is shown arranged along the exhaust passage 48 downstream of the exhaust gas sensor 126. The device 70 may be a three way catalyst (TWC), $NO_x$ trap, various other emission control devices, or combinations thereof. In some examples, during operation of the engine 10, the emission control device 70 may be periodically reset by operating at least one cylinder of the engine within a particular air-fuel ratio.

An exhaust gas recirculation (EGR) system 140 may route a desired portion of exhaust gas from the exhaust passage 48 to the intake manifold 44 via an EGR passage 152. The amount of EGR provided to the intake manifold 44 may be varied by the controller 12 via an EGR valve 144. Under some conditions, the EGR system 140 may be used to regulate the temperature of the air-fuel mixture within the combustion chamber, thus providing a method of controlling the timing of ignition during some combustion modes.

The controller 12 is shown in FIG. 2 as a microcomputer, including a microprocessor unit 102, input/output ports 104, an electronic storage medium for executable programs and calibration values shown as read only memory chip 106 (e.g., non-transitory memory) in this particular example, random access memory 108, keep alive memory 110, and a data bus. The controller 12 may receive various signals from sensors coupled to the engine 10, in addition to those signals previously discussed, including measurement of inducted mass air flow (MAF) from the mass air flow sensor 120; engine coolant temperature (ECT) from a temperature sensor 112 coupled to a cooling sleeve 114; an engine position signal from a Hall effect sensor 118 (or other type) sensing a position of crankshaft 40; throttle position from a throttle position sensor 65; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 44. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

As described above, FIG. 1 shows only one cylinder of a multi-cylinder engine, and each cylinder may similarly include its own set of intake/exhaust valves, fuel injector, spark plug, etc.

Referring now to FIG. 2, a block diagram of a vehicle driveline 200 is shown. Driveline 200 may be powered by engine 10 as shown in greater detail in FIG. 1. In one example, engine 10 may be a gasoline engine. In alternate examples, other engine configurations may be employed, for example, a diesel engine. Engine 10 may be started with an engine starting system (not shown). Further, engine 10 may generate or adjust torque via torque actuator 204, such as a fuel injector, throttle, etc.

An engine output torque may be transmitted to torque converter 206 to drive an automatic transmission 208 by engaging one or more clutches, including forward clutch 210 and gear clutches 211, where the torque converter may be referred to as a component of the transmission. Torque converter 206 includes an impeller 220 that transmits torque to turbine 222 via hydraulic fluid. One or more gear clutches 211 may be engaged to change mechanical advantage between the engine vehicle wheels 214. Impeller speed may be determined via speed sensor 225, and turbine speed may be determined from speed sensor 226 or from vehicle speed sensor 230. The output of the torque converter may in turn be controlled by torque converter lock-up clutch 212. As such, when torque converter lock-up clutch 212 is fully disengaged, torque converter 206 transmits torque to automatic transmission 208 via fluid transfer between the torque converter turbine and torque converter impeller, thereby enabling torque multiplication. In contrast, when torque converter lock-up clutch 212 is fully engaged, the engine output torque is directly transferred via the torque converter clutch to an input shaft (not shown) of transmission 208. Alternatively, the torque converter lock-up clutch 212 may be partially engaged, thereby enabling the amount of torque relayed to the transmission to be adjusted. A controller 12 may be configured to adjust the amount of torque transmitted by the torque converter by adjusting the torque converter lock-up clutch in response to various engine operating conditions, or based on a driver-based engine operation request.

Torque output from the automatic transmission 208 may in turn be relayed to wheels 214 to propel the vehicle. Specifically, automatic transmission 208 may adjust an input driving torque at the input shaft (not shown) responsive to a vehicle traveling condition before transmitting an output driving torque to the wheels.

Further, wheels 214 may be locked by engaging wheel brakes 216. In one example, wheel brakes 216 may be engaged in response to the driver pressing his foot on a brake pedal (not shown). In the similar way, wheels 214 may be unlocked by disengaging wheel brakes 216 in response to the driver releasing his foot from the brake pedal.

A mechanical oil pump (not shown) may be in fluid communication with automatic transmission 208 to provide hydraulic pressure to engage various clutches, such as forward clutch 210 and/or torque converter lock-up clutch 212. The mechanical oil pump may be operated in accordance with torque converter 206, and may be driven by the rotation of the engine or transmission input shaft, for example. Thus, the hydraulic pressure generated in mechanical oil pump may increase as an engine speed increases, and may decrease as an engine speed decreases.

Referring now to FIG. 3, an example version of engine 10 that includes multiple cylinders arranged in a V configuration is shown. In this example, engine 10 is configured as a variable displacement engine (VDE). Engine 10 includes a plurality of combustion chambers or cylinders 30. The plurality of cylinders 30 of engine 10 are arranged as groups of cylinders on distinct engine banks. In the depicted example, engine 10 includes two engine cylinder banks 30A, 30B. Thus, the cylinders are arranged as a first group of cylinders (four cylinders in the depicted example) arranged on first engine bank 30A and labeled A1-A4, and a second group of cylinders (four cylinders in the depicted example) arranged on second engine bank 30B labeled B1-B4. It will be appreciated that while the example depicted in FIG. 3 shows a V-engine with cylinders arranged on different banks, this is not meant to be limiting, and in alternate examples, the engine may be an in-line engine with all engine cylinders on a common engine bank.

Engine 10 can receive intake air via an intake passage 42 communicating with branched intake manifold 44A, 44B. Specifically, first engine bank 30A receives intake air from intake passage 42 via a first intake manifold 44A while second engine bank 30B receives intake air from intake passage 142 via second intake manifold 44B. While engine banks 30A, 30B are shown with a common intake manifold, it will be appreciated that in alternate examples, the engine may include two separate intake manifolds. The amount of air supplied to the cylinders of the engine can be controlled by adjusting a position of throttle 62 on throttle plate 64. Additionally, an amount of air supplied to each group of cylinders on the specific banks can be adjusted by varying an intake valve timing of one or more intake valves coupled to the cylinders.

Combustion products generated at the cylinders of first engine bank 30A are directed to one or more exhaust catalysts in first exhaust manifold 48A where the combustion products are treated before being vented to the atmosphere. A first emission control device 70A is coupled to first exhaust manifold 48A. First emission control device 70A may include one or more exhaust catalysts, such as a close-coupled catalyst. In one example, the close-coupled catalyst at emission control device 70A may be a three-way catalyst. Exhaust gas generated at first engine bank 30A is treated at emission control device 70A Combustion products generated at the cylinders of second engine bank 30B are exhausted to the atmosphere via second exhaust manifold 48B. A second emission control device 70B is coupled to second exhaust manifold 48B. Second emission control device 70B may include one or more exhaust catalysts, such as a close-coupled catalyst. In one example, the close-coupled catalyst at emission control device 70A may be a three-way catalyst. Exhaust gas generated at second engine bank 30B is treated at emission control device 70B.

As described above, a geometry of an exhaust manifold may affect an exhaust gas sensor measurement of an air-fuel ratio of a cylinder during nominal engine operation. During nominal engine operation (e.g., all engine cylinder operating at stoichiometry), the geometry of the exhaust manifold may allow the air-fuel ratio of certain cylinders of an engine bank to be read more predominantly when compared to other cylinders of the same bank, thus reducing a sensitivity of the exhaust gas sensor to detect an air-fuel ratio imbalance of an individual sensor. For example, engine bank 30A comprises four cylinders A1, A2, A3, and A4. During nominal engine operation, exhaust gas from A4 may flow toward a side of the exhaust manifold nearest the exhaust gas sensor 126A and therefore, give a strong, accurate exhaust sensor reading. However, during nominal engine operation, exhaust gas from A1 may flow toward a side of the exhaust manifold farthest from the exhaust gas sensor 126A and therefore, give a weak, inaccurate exhaust sensor reading. In this way, it may be difficult to attribute an air-fuel ratio (e.g., lambda) to cylinder A1 with great certainty during nominal engine operation. Thus, it may be preferred to deactivate all but one cylinder of an engine bank and to infer cylinder air-fuel ratio of the activated cylinder via torque produced by the activated cylinder. Additionally, torque produced by the activated cylinder is not affected by air that is pumped into the exhaust manifolds during cylinder deactivation via deactivated cylinders. Thus, torque produced via an activated cylinder may be decoupled from conditions produced by deactivated cylinders, whereas an air-fuel ratio signal of an activated cylinder may be corrupted via fresh air pumped via deactivated cylinders so as to make air-fuel variation detection via an oxygen sensor more difficult.

While FIG. 3 shows each engine bank coupled to respective underbody emission control devices 70A and 70B, in alternate examples, each engine bank may be coupled to a common underbody emission control device positioned downstream in a common exhaust passageway.

Various sensors may be coupled to engine 10. For example, a first exhaust gas sensor 126A may be coupled to the first exhaust manifold 48A of first engine bank 30A, upstream of first emission control device 70A while a second exhaust gas sensor 126B is coupled to the second exhaust manifold 48B of second engine bank 30B, upstream of second emission control device 70B. In further examples, additional exhaust gas sensors may be coupled downstream of the emission control devices. Still other sensors, such as temperature sensors, may be included, for example, coupled to the underbody emission control device(s). As elaborated in FIG. 1, the exhaust gas sensors 126A and 126B may include exhaust gas oxygen sensors, such as EGO, HEGO, or UEGO sensors.

One or more engine cylinders may be selectively deactivated during selected engine operating conditions. For example, during DFSO, one or more cylinders of an engine may be deactivated while the engine continues to rotate. The cylinder deactivation may include deactivating fuel and spark to the deactivated cylinders. In addition, air may continue to flow through the deactivated cylinders in which an exhaust gas sensor may measure a maximum lean air-fuel ratio upon entering the DFSO. In one example, an engine controller may selectively deactivate all the cylinders of an engine during a mode change to DFSO and then reactivate all the cylinders during a mode change back to non-DFSO mode.

Engine 10 may have a firing order of 1-3-7-2-6-5-4-8 where cylinder B1 is cylinder number one, cylinder B2 is cylinder number 2, cylinder B3 is cylinder number 3, cylinder B4 is cylinder number 4, cylinder A1 is cylinder number 5, cylinder A2 is cylinder number 6, cylinder A3 is cylinder number 7, and cylinder A4 is cylinder number 8.

Referring now to FIG. 4, an example method 400 for determining DFSO conditions in a motor vehicle is shown. DFSO may be used to increase fuel economy by shutting-off fuel injection to one or more cylinders of an engine and ceasing combustion in the deactivated cylinders. In some examples, an open-loop air-fuel ratio control during DFSO may be used to produce torque in selected cylinders while remaining cylinders are deactivated due to activation of DFSO operating mode. DFSO conditions re described in further detail below.

Method 400 begins at 402, which includes determining, estimating, and/or measuring current engine operating parameters. The current engine operating parameters may include but are not limited to a vehicle speed, throttle position, and/or an air-fuel ratio. Method 400 proceeds to 404 after engine operating conditions are determined.

At 404, the method 400 includes determining if one or more DFSO activation conditions are met. DFSO conditions may include but are not limited to one or more of an accelerator not being depressed 406, a constant or decreasing vehicle speed 408, and a brake pedal being depressed 410. An accelerator position sensor may be used to determine the accelerator pedal position. The accelerator pedal position may occupy a base position when the accelerator pedal is not applied or depressed, and the accelerator pedal may move away from the base position as accelerator application is increased. Additionally or alternatively, accelerator pedal position may be determined via a throttle position sensor in examples where the accelerator pedal is coupled to the throttle or in examples where the throttle is operated in an accelerator pedal follower mode. A constant or decreasing vehicle speed may be preferred for a DFSO to occur due to a torque demand being either constant or not increasing. The vehicle speed may be determined by a vehicle speed sensor. The brake pedal being depressed may be determined via a brake pedal sensor. In some examples, other suitable conditions may exist for DFSO to occur.

At 412, the method 400 judges if one or more of the above listed DFSO conditions are met. If the condition(s) is met, the answer is yes and method 400 proceeds to 502 of method 500, which will be described in further detail with respect to FIG. 5. If none of the conditions are met, the answer is no and method 400 proceeds to 414 maintain current engine operating parameters and not initiate DFSO. The method may exit after current engine operating conditions are maintained.

In some examples, a GPS/navigation system may be used to predict when DFSO conditions will be met. Information used by the GPS to predict DFSO conditions being met may include but is not limited to route direction, traffic information, and/or weather information. As an example, the GPS may be able to detect traffic downstream of a driver's current path and predict one or more of the DFSO condition(s) occurring. By predicting one or more DFSO condition(s) being met, the controller may be able to plan when to initiate DFSO.

Method 400 is an example method for a controller (e.g., controller 12) to determine if a vehicle may enter DFSO. Upon meeting one or more DFSO conditions, the controller (e.g., the controller in combination with one or more additional hardware devices, such as sensors, valves, etc.) may perform method 500 of FIG. 5.

Referring now to FIG. 5, an exemplary method 500 for determining if open-loop air-fuel ratio control conditions are met is shown. In one example, open-loop air-fuel ratio control may be initiated after a threshold number of vehicle miles are driven (e.g., 2500 miles). In another example, open-loop air-fuel ratio control may be initiated during the next DFSO event after sensing an air-fuel ratio disturbance downstream of a catalyst which may be indicative or cylinder to cylinder air-fuel imbalance during standard engine operating conditions (e.g., all cylinders of an engine are firing). During the open-loop air-fuel ratio control, a selected group of cylinders may be fired (e.g., combustion may be performed in the select group of cylinders) while remaining cylinders remain deactivated in DFSO mode.

Referring now to FIG. 5, method 500 will be described herein with reference to components and systems depicted in FIGS. 1-3, particularly, regarding engine 10, cylinder banks 30A and 30B, sensor 126, and controller 12. Method 500 may be carried out by controller 12 according to computer-readable media stored thereon. It should be understood that the method 500 may be applied to other systems of a different configuration without departing from the scope of this disclosure.

Method 500 begins at 502 where DFSO is initiated based on determination of DFSO conditions being met during method 400. Initiating DFSO includes shutting off a fuel supplied to all the cylinders of the engine such that combustion may no longer occur (e.g., deactivating the cylinders). Method 500 proceeds to 504 after DFSO is initiated.

At 504, the method 500 determines if conditions for determining and/or correcting cylinder air-fuel imbalance were present during nominal engine operation prior to the DFSO. Conditions for correcting cylinder air-fuel imbalance may include but are not limited to the vehicle traveling a predetermined distance and/or catalyst breakthrough of engine exhaust gases as indicated by leaner or richer exhaust gases downstream of a catalyst. Further, in some examples, engine feed gas air-fuel ratio varying by more than a predetermined amount may be determined to indicate cylinder to cylinder air-fuel imbalance. If no air-fuel ratio imbalance was detected and/or the threshold distance was not traveled, the answer is no and method 500 proceeds to 506. If an air-fuel ratio imbalance was detected, the answer is yes and method 500 proceeds to 508.

At 506, method 500 continues operating the engine in DFSO mode until conditions are present where exiting DFSO is desired. In one example, exiting DFSO may be desired when a driver applies the accelerator pedal or when engine speed is reduced to less than a threshold speed. Method 500 exits if conditions are present to exit DFSO mode.

At 508, method 500 monitors conditions for entering open-loop air-fuel. For example, method 500 senses an air-fuel ratio or lambda in the exhaust system (e.g., via monitoring exhaust oxygen concentration) to determine if combusted byproducts have been exhausted from engine cylinders and the engine cylinders are pumping fresh air. After DFSO is initiated, the engine exhaust evolves progressively leaner until the lean air-fuel ratio reaches a saturated value. The saturated value may correspond to an oxygen concentration of fresh air, or it may be slightly richer than a value that corresponds to fresh air since a small amount of hydrocarbons may exit the cylinders even though fuel injection has been cut-off for several engine revolutions. Method 500 monitors the engine exhaust to determine if oxygen content in the exhaust gases has increased to greater than a threshold value. The conditions may further include identifying if a vehicle is proceeding at a constant speed or decreasing speed. Method 500 continues to 510 after beginning to monitor the exhaust air-fuel ratio.

At 510, method 500 judges if conditions to enter open-loop air-fuel control have been met. In one example, the select conditions are that the exhaust air-fuel ratio is leaner that a threshold value for a predetermined amount of time (e.g., 1 second). In one example, the threshold value is a value that corresponds to being within a predetermined percentage (e.g., 10%) of a fresh air reading sensed at the oxygen sensor. If the conditions are not met, the answer is no and method 500 returns to 508 to continue to monitor if select conditions for entering open-loop air-fuel control have been met. If the conditions for open-loop air-fuel ratio control are met, the answer is yes and method 500 proceeds to 512 to initiate open-loop air-fuel ratio control. The method 500 proceeds to 602 of method 600 if conditions for open-loop fuel control are present.

The inventors herein have determined that engine torque estimates of one cylinder may be influenced by torque produced by cylinders adjacent in a firing order of the engine because there may be less than 100 crankshaft degrees of separation between engine torque pulses. Further, cylinder air-fuel ratios sensed via an oxygen sensor may be influenced due to geometry of an exhaust passage relative to a location of an exhaust sensor or other conditions. The inventors have further determined that during DFSO, an improved cylinder torque estimate for a cylinder may be provided since torque production of deactivated cylinders is low. Further, cylinder torque estimates may not be influenced by exhaust system geometry or oxygen sensor location.

Method 500 may be stored in non-transitory memory of controller (e.g., controller 12) to determine if a vehicle may initiate open-loop air-fuel ratio control during DFSO. Upon meeting one or more open-loop air-fuel ratio control conditions, the controller (e.g., the controller in combination with one or more additional hardware devices, such as sensors, valves, etc.) may perform method 600 of FIG. 6.

Referring now to FIG. 6, an exemplary method 600 for preforming open-loop air-fuel ratio control and determining cylinder to cylinder air-fuel variation based on cylinder torque is shown. In one example, open-loop air-fuel ratio control may select a cylinder group in which to reactivate combustion of air-fuel mixtures and estimate cylinder torque of reactivated cylinders while other remaining engine cylinders remain deactivated during DFSO. In one example, the cylinder group may be a pair of corresponding cylinders of separate cylinder banks spaced apart and not adjacent to each other in a firing order of the engine. The cylinders of a group may be selected based on either a cylinder firing order or location. As an example, with respect to FIG. 3, the engine may have a firing order of 1-3-7-2-6-5-4-8 and cylinders B1 and A2 may comprise a cylinder group. Thus, torque produced by cylinders B1 and A2 are separated by 360 crankshaft degrees where the engine is a four stroke engine. In this way, a greatest number of crankshaft degrees may separate torque produced by reactivated cylinders to improve the torque signal to noise ratio. Further, the cylinders are selected to combust air-fuel mixtures 360 crankshaft degrees apart to provide even firing and smooth torque production. In some examples, only a single cylinder may comprise the cylinder group for an in-line engine or for a V-engine, for example.

Method 600 will be described herein with reference to components and systems depicted in FIGS. 1-3, particularly, regarding engine 10, cylinder banks 30A and 30B, sensor 126, and controller 12. Method 600 may be carried out by the controller executing computer-readable media stored thereon. It should be understood that the method 600 may be applied to other systems of a different configuration without departing from the scope of this disclosure.

The approach described herein senses changes in torque production of activated cylinders while other engine cylinders are deactivated in DFSO mode by comparing engine acceleration during a power stroke of an activated cylinder with predetermined torque values that correspond to a desired air-fuel ratio for the activated cylinders. If the activated cylinder or cylinders produce a torque greater than is expected, it may be determined that the activated cylinder or cylinders is receiving a richer mixture than is desired. If the activated cylinder or cylinders produce a torque less than is expected, it may be determined that the activated cylinder or cylinders is receiving a leaner mixture than is desired. For cylinders that are richer than desired, a factor (e.g., a scalar such as 1.02) may be applied to a desired fuel mass to correct the cylinder air-fuel ratio and torque of the cylinder indicating more torque than is desired. Likewise, a scalar may be applied to the desired fuel mass of a cylinder indicating less torque than is desired. In this way, fuel supplied to cylinders may be adjusted so that the cylinders produce an expected torque based on an expected cylinder air fuel ratio so that the cylinder's air-fuel ratio may be corrected.

At 602, method 600 selects a cylinder group to later be activated by injecting fuel into cylinders of the group and combusting the fuel during the open-loop air-fuel ratio control. Selection of the cylinder group may be based on one or more of a firing order and cylinder location. As one example, cylinders B1 and A2 of FIG. 3 may be selected based on engine firing order or combustion order so that combustion events are separated by 360 crankshaft degrees. Likewise, cylinders B4 (e.g., cylinder number 4) and cylinder A3 (e.g., cylinder number 7) may be selected as a second group of cylinders. Such a selection may reduce the possibility of influencing an estimate of torque produced by one cylinder in the selected group by torque produced by another cylinder in the selected group. Additionally, the cylinder group may comprise at least one cylinder. In some examples, the cylinder group may comprise a plurality of cylinders, further comprising only one cylinder from each cylinder bank. In this way, a number of cylinders in a cylinder group may be equal to a number of cylinder banks, in which each cylinder bank includes only one cylinder combusting air and fuel during an engine cycle (e.g., two revolutions for a four-stroke engine).

After selecting the cylinder group, method 600 proceeds to 603 to determine if conditions for fuel injection to the selected cylinder group are met. Conditions for initiating fuel injection may be determined as described in method 1000 of FIG. 10. If the fuel injection conditions are not met, the answer is no and method 600 proceeds to 604 to continue to monitor fuel injection conditions and determine if fuel injection conditions are met at a later point in time. If the fuel injection conditions are met, the answer is yes and method 600 may proceed to 605 to combust air and fuel in the selected cylinder group (e.g., firing the cylinder group).

At 605, method 600 injects fuel into cylinders in the group to initiate combustion in selected cylinders while other engine cylinders remain deactivated based on DFSO conditions. Initiating combustion in the selected cylinder group includes injecting fuel to only the selected cylinder group while maintaining the remaining cylinders as deactivated (e.g., no fuel injected) while the engine continues to rotate. Method 600 may fire the selected group of cylinders one or more times to produce torque perturbation of the engine crankshaft to accelerate the engine due to each combustion event in the reactivated cylinder(s). Fuel is injected into the cylinder before the cylinder fires. For example, if the selected cylinder group comprises cylinders B1 and A2, then both cylinder B1 and cylinder A2 fire. Firing cylinder B1 produces a torque perturbation in crankshaft torque during the crankshaft interval corresponding to the power stroke of cylinder B1. Firing cylinder A2 produces a torque perturbation in crankshaft torque during the crankshaft interval corresponding to the power stroke of cylinder A2. The amount of fuel injected to the reactivated cylinders is based on engine speed and air flow through the cylinders receiving fuel. The desired amount of fuel injected to the reactivated cylinders is an amount that causes a cylinder air-fuel mixture that is lean of stoichiometry, but rich of an amount where engine combustion stability is less than a threshold level as is shown in FIG. 9. As a result, if less fuel than desired is injected to the engine, the cylinder produces less torque and accelerates the engine less than is desired. If more furl than desired is injected to the engine, the cylinder produces more torque and accelerates the engine more than is desired. Method 600 proceeds to 606 after cylinders in a selected group are reactivated.

At 606, the method 600 determines engine acceleration. Engine acceleration is related to engine torque by the equation $T=j\dot{\omega}$ where T is engine torque, j is inertia of the engine and the perceived inertia applied to the engine via the torque converter, and $\dot{\omega}$ is engine angular acceleration. Engine acceleration is determined by dividing a crankshaft distance between two known crankshaft positions by a time it takes the engine to rotate through the distance. Engine inertia may be determined via indexing tables or functions that describe engine inertia and perceived inertia at the torque converter via engine speed, transmission gear, road grade, and vehicle mass. In one example, engine acceleration is determined during a power stroke of the cylinder in the selected group receiving the fuel so that engine torque is highly correlated to the air-fuel ratio in the cylinder receiving the fuel. The tables or functions include empirically determined values that increase or decrease the perceived inertia coupled to the engine at the torque converter based on transmission gear, road grade, and vehicle mass. Vehicle mass and road grade may be inferred via an accelerometer via known methods. The engine acceleration is multiplied by the inertia to estimate engine torque. Alternatively, method 600 may simply determine engine acceleration as a basis for adjusting fueling of cylinders in the group receiving fuel. Method 600 proceeds to 608 after engine acceleration is determined.

At 608, method 600 judges whether or not engine torque or acceleration variation relative to a base engine torque or acceleration is present. Cylinder to cylinder air-fuel imbalance may result from an air-fuel ratio of one or more cylinders deviating from a desired or expected engine air-fuel ratio. Cylinder lambda variation may be determined based on comparing a base engine torque to an actual engine torque or base engine acceleration to actual engine acceleration. The actual engine acceleration compensated for transmission gear, road grade, and vehicle mass as described at 606. In one example, engine torque variation is determined to be present if the absolute value of base engine torque minus the actual engine torque is greater than a threshold torque. Likewise, engine acceleration variation may be determined to be present if the absolute value of base engine acceleration minus the actual engine acceleration is greater than a threshold. If the engine torque or acceleration variation is determined, the answer is yes and method 600 proceeds to 610. Otherwise, the answer is no and method 600 proceeds to 612.

It should also be noted that if a transmission shift request is made during the time fuel is injected to the reactivated cylinders, injection of fuel ceases until the shift is complete. If a transmission shift request occurs between injections in different cylinders as is shown in FIG. 8, injection of fuel and engine torque or acceleration variation analysis is delayed until the shift is complete. By not performing engine torque or acceleration analysis and fuel injection during the transmission shift, the possibility of inducing engine torque variation due to gear shifting may be reduced.

At 610, the method 600 includes learning the fuel injector fueling error. Learning the fuel injector fueling error is based on the difference between the desired engine torque and the actual engine torque or the difference between desired engine acceleration and actual engine acceleration for the power stroke of the cylinder receiving fuel. For example, a base engine torque when a desired amount of fuel is provided to the cylinder may be X Nm. The actual engine torque may be determined to be Y Nm. The torque error is determined as the desired engine torque (X Nm) minus the actual engine torque (Y Nm). If the torque error is greater than a threshold value, the amount of fuel injected to the cylinder receiving fuel when the engine resumes combustion after the DFSO event may be multiplied by a scalar that is based on the engine torque error value. By way if illustration, if a desired lambda (e.g., air-fuel ratio divided by stoichiometric air-fuel ratio) value for a cylinder receiving fuel is 1.0 and the fuel adjustment scalar is determined to be 1.03, fuel injected to the cylinder is increased by three percent to remove the air-fuel imbalance in the cylinder as determined based on cylinder torque error the cylinder produced while the engine operated in DFSO mode. The fuel adjustment scalar value may be empirically determined and stored to memory which is indexed via engine torque error or engine acceleration error. A fuel adjustment scalar may be stored for each cylinder so that a plurality of scalars for adjusting engine fueling after DFSO is provided. Method 600 proceeds to 612 after engine fueling adjustments based on engine torque or engine acceleration are determined for the cylinder in the selected group.

At 612, the method 600 judges if scalar fuel adjustment values have been determined for all cylinders. If scalar fuel adjustment values of all cylinders have not been assessed, then the answer is no and method 600 proceed to 613. Otherwise, the answer is yes and method 600 proceeds to 616.

At 613, method 600 judges whether or not DFSO conditions are met or present. A driver may apply an accelerator pedal or engine speed may fall to a speed less than desired so that DFSO conditions are not met. If DFSO conditions are not met, the answer is no and method 600 proceeds to 614. Otherwise, the answer is yes and method 600 proceeds to 615.

At 614, method 600 exits DFSO and returns to closed-loop air-fuel control. Cylinders are reactivated via supplying spark and fuel to the deactivated cylinders. Further, the desired lambda value for each cylinder is multiplied by the cylinder's corresponding fuel adjustment scalar determined at 610. In this way, the open-loop air-fuel ratio control may be disabled despite not having acquired lambda values for all cylinders of the engine. In some examples, if an open-loop air-fuel ratio control is disabled prematurely, then the controller may store any fuel adjustment scalar values for the selected cylinder group(s) and consequently, select a different cylinder group(s) initially during the next open-loop air-fuel ratio control. Thus, if fuel adjustment scalar values are not acquired for a cylinder group during an open-loop air-fuel ratio control, the cylinder group may be the first cylinder group for which fuel adjustment scalar values are determined for establishing the presence or absence of imbalance during a subsequent DFSO event. Method 600 proceeds to exit after engine returns to closed-loop air-fuel control.

At 615, method 600 selects a next cylinder group for determining lambda values for establishing the presence or absence of imbalance. Selecting the next cylinder group may include selecting different cylinders other than the cylinders selected in the preceding cylinder group. For example, cylinders B2 and A4 may be selected instead of B1 and A2. Further, fuel supplied to cylinders in the previously selected group is deactivated. Method 600 returns to 603 to reactivate the selected cylinder group, as described above.

At 616, method 600 deactivates open-loop air-fuel ratio control including terminating cylinder activation and selection of cylinder groups. Therefore, method 600 returns to nominal DFSO where all cylinders are deactivated and where cylinder imbalance is not determined. Method 600 proceeds to 618 after the engine renters nominal DFSO.

At 618, method 600 judges whether or not DFSO conditions are met. If the answer is no, method 600 proceeds to 620. Otherwise, the answer is yes and method 600 returns to 618. DFSO conditions may no longer be met if engine speed is reduced to less than a threshold or if the accelerator pedal is applied.

At 620, the method 600 exits DFSO and reactivates all cylinders in closed-loop fuel control. The cylinders may be reactivated according to the firing order of the engine. Method 600 proceeds to 622 after engine cylinders are reactivated.

At 622, method 600 adjusts cylinder operation of any cylinders exhibiting engine torque or acceleration variation as determined at 608. The adjusting may include multiplying desired lambda values for the cylinder by fuel adjustment scalars described at 610. Thus, fuel injection timing adjustments may be proportional to the difference between the desired engine torque and actual engine torque for the cylinder receiving fuel. For example, if one cylinder indicates more torque than expected, then the fuel adjustments may include one or more of injecting less fuel and providing more air to the cylinder exhibiting more torque than is expected. Method 600 may exit after applying the adjustments corresponding to the learned fueling errors for each cylinder.

Thus, the method of FIGS. 4-6 provide for a method, comprising: during a deceleration fuel shut-off (DFSO) event where all cylinders of an engine are deactivated, selectively sequentially combusting air and fuel in cylinders of a cylinder group in the engine, each cylinder fueled via a fuel pulse width, and adjusting fuel injected to one or more cylinders in the cylinder group in response to variation of engine torque from an expected engine torque during the DFSO event. The method further comprises adjusting subsequent engine operation based on the indicated engine torque variation. The method includes where the cylinder group is selected based on one or more of a firing order and a cylinder position within the firing order. The method includes where fueling of the cylinder group upon which the variation of cylinder torque is based occurs only after the maximum lean air-fuel ratio is measured during the DFSO.

In some examples, the method includes where adjusting subsequent engine operation includes adjusting a fuel injector pulse width in response to an expected engine torque variation. The method includes where an expected engine torque variation is based on a selected fuel pulse width. The method includes where adjusting subsequent engine operation includes adjusting subsequent fuel injections to a cylinder based on the indicated engine torque variation following termination of the DFSO. The method includes where the cylinder group is fueled and operated to perform a combustion cycle a plurality of times during the DFSO producing a plurality of engine torque that are together used to identify the imbalance.

The method of FIGS. 4-6 also provides for a method, comprising: after disabling all engine cylinders leading to a substantially common exhaust gas output of an engine, individually fueling one or more of the disabled cylinders to combust a lean air-fuel mixture; and adjusting fuel injected to at least one cylinder in response to a variation of engine torque from a base engine torque produced via the lean air-fuel mixture, the base engine torque compensated for vehicle dynamics. The method includes where vehicle dynamics include vehicle mass. The method includes where vehicle dynamics include road grade. The method includes where vehicle dynamics include a present active transmission gear. The method m 9, further comprises not determining variation of cylinder torque from the base cylinder torque in response to a request to change a transmission gear. The method includes where the substantially common exhaust gas output is air, and where the lean air-fuel ratio is a predetermined air-fuel ratio from a lean air-fuel ratio combustion stability limit. The method further comprises increasing an amount of fuel injected to the at least one cylinder in response to less than a desired amount of torque being produced by the cylinder.

The methods of FIGS. 4-6 also provide for a method, comprising: after disabling all cylinders leading to a substantially common exhaust gas output of an engine, delaying individually fueling one or more of the disabled cylinders to combust a lean air-fuel mixture in response to a driveline zero torque point; and adjusting fuel injected to at least one cylinder in response to a variation of engine torque from a base engine torque produced by the lean air-fuel mixture. The method includes where the driveline zero torque point is based on torque converter impeller speed and torque converter turbine speed. The method includes where the variation of engine torque is a difference between a desired engine torque and an actual engine torque. The method further comprises reactivating all engine cylinders in response to a driver demand. The method includes where all cylinders are disabled responsive to an engine load less than a threshold.

Referring now to FIG. 7, an operating sequence 700 according to the method of FIGS. 4-6 is shown. In this example, the engine is a six cylinder engine having two cylinder banks with three engine cylinders in each cylinder bank. Line 702 represents if DFSO is occurring or not, line 704 represents activation or deactivation of an injector of a first cylinder, line 706 represents an injector of a second cylinder, line 708 represents an injector of a third cylinder, and solid line 710 represents engine speed. For lines 704, 706, and 708, a value of "1" represents a fuel injector injecting fuel (e.g., cylinder firing) and a value of "0" represents no fuel being injected (e.g., cylinder deactivated). The horizontal axes if each plot represent time and time increases from the left side of the figure to the right side of the figure. The vertical axis of the fifth plot from the top if FIG. 7 is engine speed and engine speed increases in a direction toward the top of FIG. 7.

Prior to time T1, the first, second, and third cylinders are firing under nominal engine operation (e.g., stoichiometric air-fuel ratio), as illustrated by lines 704, 706, and 708 respectively. As a result, the engine speed is at a higher constant level. Thus, the engine is not accelerating or decelerating. DFSO is disabled, as indicated by line 702.

At time T1, DFSO conditions are met and DFSO is initiated, as described above with respect to FIG. 4. As a result, fuel is no longer injected into all the cylinders of the engine (e.g., cylinders are deactivated) and engine speed begins to decline. Thus, the engine is decelerating.

After time T1 and prior to time T2, DFSO continues and the engine continues to decelerate. The fuel injectors may not begin injecting fuel until a threshold time (e.g., 5 seconds) has passed subsequent to initiating the DFSO. Additionally or alternatively, the injectors may begin injecting fuel in response to the maximum air-fuel ratio being detected by the UEGO sensor. Conditions for firing a selected cylinder group are monitored.

At time T2, the first cylinder is activated due to conditions for firing the selected cylinder group being met (e.g., no zero point torque, vehicle speed is less than a threshold vehicle speed, and no downshift) and therefore, injector 1 injects fuel into the first cylinder. As described above, a selected cylinder group may comprise at least one cylinder from each cylinder bank. That is to say, the number of cylinder banks may be equal to the number of cylinders in the cylinder group, in which each cylinder bank provides one cylinder to the cylinder group. Additionally or alternatively, a selected cylinder group for an in-line engine may comprise at least one cylinder of the engine.

After time T2 and prior to time T3, the first cylinder is combusting. As shown, the first cylinder combusts four times and produces four separate fuel pulse widths, each fuel pulse width corresponding to a single combustion event. The engine deceleration rate slows in response to torque produced via the activated cylinder.

Engine torque values during a power stroke of first cylinder receiving fuel are compared to a base engine torque value. If the measured engine torque values are not equal to the desired engine torque value, then an engine torque variation and its corresponding fuel adjustment scalar may be determined as described above with respect to FIG. 6. In this example, the engine torque meets the desired engine torque.

At time T3, the first cylinder is deactivated and DFSO continues. The air-fuel ratio returns to the maximum lean air-fuel ratio. After time T3 and prior to time T4, the DFSO continues without firing a selected cylinder group. As a result, the engine decelerates at an increased rate. The open-loop air-fuel ratio control may select a next cylinder group to fire. The open-loop air-fuel ratio control may allow the air-fuel ratio (not shown) to return to the maximum lean air-fuel ratio prior to firing the next cylinder group to reestablish the base engine deceleration rate. Conditions for firing the next cylinder group are monitored.

In some examples, additionally or alternatively, firing the next cylinder group may occur directly after firing a first cylinder group. In this way, the open-loop air-fuel ratio control may select the next cylinder group at time T3 and not allow the lambda to return to the maximum lean air-fuel ratio, for example.

At time T4, the second cylinder is activated and injector 2 injects fuel into the second cylinder due to cylinder firing conditions being met. The DFSO continues and the first and third cylinders remain deactivated. After time T4 and prior to time T5, the second cylinder is fired four times and four fuel pulse widths are produced, each fuel pulse width corresponding to a single combustion event in the second cylinder. The engine deceleration rate is reduced in response to torque being produced by the cylinder. The engine torque meets the desired engine torque.

At time T5, the second cylinder is deactivated and as a result, the engine deceleration rate increases and DFSO continues. After time T5 and prior to time T6, the open-loop air-fuel ratio control selects a next cylinder group and allows the lambda to return to the maximum lean air-fuel ratio prior to firing the next cylinder group. DFSO continues with all the cylinders remaining deactivated. Conditions for firing the next cylinder group are monitored.

At time T6, the third cylinder is activated and injector 3 injects fuel into the third cylinder due to cylinder firing conditions being met. The DFSO continues and the first and second cylinders remains deactivated. After time T6 and prior to time T7, the third cylinder is fired four times and four fuel pulse widths are produced, each fuel pulse width corresponding to a single combustion event within the third cylinder. However, the engine rate of deceleration continues at a higher level as compared to engine deceleration beginning at times T2 and T4. The lower torque produced in the third cylinder corresponds to a leaner air-fuel ratio in the third cylinder as compared to the first and second cylinders. Therefore, the third cylinder has an air-fuel ratio imbalance, more specifically, a lean air-fuel ratio error or variance. The engine torque error and fuel adjustment scalar for the third cylinder are learned and may be applied to future third cylinder operations during engine operations subsequent the DFSO.

At time T7, the third cylinder is deactivated to deactivate all engine cylinders. The open-loop air-fuel ratio control is also deactivated and DFSO may continue until DFSO conditions are no longer met. After time T7 and prior to time T8, DFSO continues and all cylinders remain deactivated.

At time T8, the DFSO conditions are no longer met (e.g., tip-in occurs) and the DFSO is deactivated. Deactivating the DFSO includes injecting fuel into all the cylinders of the engine. Therefore, the first cylinder receives fuel from the injector 1 and the second cylinder receives fuel from the injector 2 without any adjustments learned during the open-loop air-fuel ratio control. The fuel injector of the third cylinder may receive fuel injection timing adjustments based on the learned engine torque variation to increase fuel supplied to the third cylinder. The adjustment(s) may include injecting an increased amount of fuel compared to fuel injections during similar conditions prior to the DFSO because the learned engine torque and fuel adjustment scalar is based on a lean air-fuel ratio variation. By injecting an increased amount of fuel, the third cylinder air-fuel ratio may be substantially equal to air-fuel ratios of other engine cylinders. After time T8, nominal engine operation continues. DFSO remains deactivated. The first, second, and third cylinders are fired.

Referring now to FIG. 8, a vehicle DFSO sequence where engine torque variation analysis is delayed to reduce the possibility of engine torque error is shown. Sequence 800 shows fuel injection for a second cylinder being delayed in response to a transmission shift request. Example results for an engine cylinder bank comprising three cylinders (e.g., V6 engine with two cylinder banks, each bank comprising three cylinders) are shown. Line 802 represents if DFSO is occurring or not, line 804 represents an injector of a first cylinder, line 806 represents an injector of a second cylinder, line 808 represents whether or not a transmission shift request is present, and solid line 810 represents engine speed. For lines 804 and 806, a value of "1" represents a fuel injector injecting fuel (e.g., cylinder firing) and a value of "0" represents no fuel being injected (e.g., cylinder deactivated). A transmission shift request is present when line 808 is at a higher level. A transmission shift request is not present when line 808 is at a lower level. The horizontal axes if each line represent time and time increases from the left side of the figure to the right side of the figure. Engine speed increases in a direction toward the top of FIG. 8.

Prior to time T10, the first and second cylinders are firing under nominal engine operation (e.g., stoichiometric air-fuel ratio), as illustrated by lines 804 and 806. A transmission shift is not requested. The engine speed is maintained at a constant level as indicated by line 810. DFSO is disabled, as indicated by line 802.

At time T10, DFSO conditions are met and DFSO is initiated, as described above with respect to FIG. 4. As a result, fuel is no longer injected into all the cylinders of the engine (e.g., cylinders are deactivated) and the engine begins to decelerate.

After time T10 and prior to time T11, DFSO continues and the engine continues to decelerate. The fuel injectors may not begin injecting fuel until a threshold time (e.g., 5 seconds) has passed subsequent to initiating the DFSO. Additionally or alternatively, the fuel injectors may not begin injecting fuel until the maximum air-fuel ratio is detected by the UEGO sensor. Conditions for firing a selected cylinder group are monitored.

At time T11, the first cylinder is activated due to conditions for firing the selected cylinder group being met (e.g., no zero point torque, vehicle speed is less than a threshold vehicle speed, and no downshift) and therefore, injector 1 injects fuel into the first cylinder. As described above, a selected cylinder group may comprise at least one cylinder from each cylinder bank. That is to say, the number of cylinder banks may be equal to the number of cylinders in the cylinder group, in which each cylinder bank provides one cylinder to the cylinder group. Additionally or alternatively, a selected cylinder group for an in-line engine may comprise at least one cylinder of the engine. Furthermore, the selected cylinder group may be selected based on one or more of a firing order and location, in which the cylinders are sequentially selected to comprise a selected cylinder group to be fired. For example, with respect to FIG. 3, cylinders B1 and A2 may comprise a first selected cylinder group. After testing the first selected cylinder group, a second selected cylinder group may comprise cylinders B2 and A4 to be fired. In this way, the cylinders may be selected sequentially for future select cylinder groups.

After time T11 and prior to time T12, the first cylinder is combusting. As shown, the first cylinder combusts four times and produces four separate fuel pulse widths, each fuel pulse width corresponding to a single combustion event. The engine deceleration slows in response to torque being produced by the cylinder receiving fuel. As will be appreciated by one skilled in the art, other suitable numbers of firings may be performed.

Engine torque for the first cylinder combusting is compared to a desired engine torque. If the measured engine torque value is not equal to or within a threshold range of the expected engine torque value, then an engine torque variation resulting from cylinder air-fuel imbalance may be indicated and learned along with a fuel adjustment scalar, as described above with respect to FIG. 6.

At time T12, the first cylinder is deactivated and DFSO continues. The air-fuel ratio returns to the maximum lean air-fuel ratio. After time T12 and prior to time T13, the DFSO continues without firing a selected cylinder group. As a result, the engine deceleration rate increases. The open-loop air-fuel ratio control may select a next cylinder group to fire. The open-loop air-fuel ratio control may allow the air-fuel ratio to return to the maximum lean air-fuel ratio prior to firing the next cylinder group in order maintain a consistent background (e.g., the maximum lean air-fuel ratio) for each cylinder group. Conditions for firing the next cylinder group are monitored.

At time T13, the second cylinder is prepared for activation, but a request for a transmission shift is made as indicated by line 808 transitioning to a higher level. The second cylinder activation is delayed in response to the transmission shift request to reduce the possibility of inducing torque errors in the output of the second cylinder. The engine stays in DFSO and the shift commences. Activation of the second cylinder is delayed until the shift is complete. The shift (e.g., a downshift) is complete shortly before time T14.

At time T14, the second cylinder is activated and injector 2 injects fuel into the second cylinder due to cylinder firing conditions being met. The DFSO continues and the first cylinder remains deactivated. After time T14 and prior to time T15, the second cylinder is fired four times and four fuel pulse widths are produced, each fuel pulse width corresponding to a single combustion event in the second cylinder. The engine rate of deceleration decreases due to torque produced via the active engine cylinder.

At time T15, the second cylinder is deactivated and as a result, the engine deceleration rate increases and DFSO continues. After time T15 and prior to time T16, the open-loop air-fuel ratio control allows the lambda to return to the maximum lean air-fuel ratio (not shown). DFSO continues with all the cylinders remaining deactivated.

At time T16, DFSO conditions are no longer present so the first and second cylinders are reactivated. The engine air-fuel ratio resumes stoichiometric and the engine begins to produce positive torque.

Thus, analysis of engine torque variation and firing of cylinders while the engine's remaining cylinders remain deactivated may be delayed in response to a transmission request. Further, if a transmission request occurs when a cylinder is active while other cylinders are deactivated, engine torque variation analysis including firing the one active cylinder may be delayed until the shift is complete. In this way, the possibility of engine torque estimation errors due to transmission gear shifting may be reduced.

Turning now to FIG. 9, an example plot of cylinder torque versus air-fuel ration is shown. The vertical axis represents cylinder torque and cylinder torque increases in the direction of the vertical axis arrow. The horizontal axis represents cylinder air-fuel ratio. Vertical line 904 represents a stoichiometric air-fuel ratio. Air-fuel ratios to the right of vertical line 904 are increasingly lean in the direction of the horizontal axis arrow. Air-fuel ratios to the left of vertical line 904 are increasingly rich in the direction of the vertical axis. Vertical line 906 represents a combustion stability limit threshold. Air-fuel ratios to the right of vertical line 906 provide decreasing combustion stability. Air-fuel ratios to the left of vertical line 904 provide increasing combustion stability.

Curve 902 shows that cylinder torque is greatest at 920 which is rich of stoichiometry. Cylinder torque decreases as engine air-fuel ratio increases. The engine air-fuel ratio during DFSO may be as shown at 910. A desired cylinder air-fuel ratio during DFSO to assess cylinder to cylinder air-fuel imbalance may be provided as shown at 922. Thus, the desired air-fuel ratio at 922 is lean of stoichiometry 904 and rich of a combustion stability limit 906. Selecting the desired air-fuel ratio 922 lean of stoichiometry, but rich of a combustion stability limit allows for the possibility of fuel injection errors without exceeding the combustion stability limit so that increased engine emissions and driveline torque disturbances may be less likely.

A richer than desired cylinder air-fuel ratio is shown at 926. The increased cylinder torque production between the desired cylinder air-fuel ratio 922 and the richer cylinder air-fuel ratio 926 is indicated by the distance of line 930. The decreased cylinder air-fuel ratio is indicated by the distance of line 932.

A leaner than desired cylinder air-fuel ratio is shown at 924. The decreased cylinder torque production between the desired cylinder air-fuel ratio 922 and the leaner cylinder air-fuel ratio 924 is indicated by the distance of line 940. The increased cylinder air-fuel ratio is indicated by the distance of line 942.

Thus, it may be observed that cylinder torque correlates with cylinder air-fuel ratio. Further, based on the increase or decrease in expected or desired engine torque, a deviation in cylinder air-fuel ratio may be determined.

Referring now to FIG. 10, a method for judging whether or not to supply fuel to reactivate deactivated cylinders for the purpose of determining cylinder imbalance is shown.

The method of FIG. 10 may be applied in conjunction with the method of FIGS. 4-6 to provide the sequences shown in FIGS. 7-8. Alternatively, the method of FIG. 10 may be the basis for when samples of engine torque may be a basis for determining cylinder air-fuel imbalance.

At 1002, method 1000 judges whether or not a request to shift transmission gears is present or if a transmission gear shift is in progress. In one example, method 1000 may determine a shift is requested or in progress based on a value of a variable in memory. The variable may change state based on vehicle speed and driver demand torque. If method 1000 judges that a transmission gear shift is requested or in progress, the answer is yes and method 1000 proceeds to 1016. Otherwise, the answer is no and method 1000 proceeds to 1004. By not injecting fuel to deactivated cylinders during transmission gear shifts, engine torque variation may be reduced to improve the engine torque signal to noise ratio.

At 1004, method 1000 judges whether or not a request engine speed is within a desired speed range (e.g., 1000-3500 RPM). In one example, method 1000 may determine engine speed from an engine position or speed sensor. If method 1000 judges that the engine speed is within a desired range, the answer is yes and method 1000 proceeds to 1006. Otherwise, the answer is no and method 1000 proceeds to 1016. By not injecting fuel to deactivated cylinders when engine speed is out of range, engine torque variation may be reduced to improve the engine torque signal to noise ratio.

At 1006, method 1000 judges whether or not a request engine deceleration is within a desired range (e.g., less than 300 RPM/sec.). In one example, method 1000 may determine engine deceleration from the engine position or speed sensor. If method 1000 judges that the engine deceleration is within a desired range, the answer is yes and method 1000 proceeds to 1008. Otherwise, the answer is no and method 1000 proceeds to 1016. By not injecting fuel to deactivated cylinders when engine deceleration rate is out of range, engine torque ratio variation may be reduced to improve the engine torque signal to noise ratio.

At 1008, method 1000 judges whether or not engine load is within a desired range (e.g., between 0.1 and 0.6). In one example, method 1000 may determine engine load from an intake manifold pressure sensor or a mass air flow sensor. If method 1000 judges that the engine load is within a desired range, the answer is yes and method 1000 proceeds to 1009. Otherwise, the answer is no and method 1000 proceeds to 1016. By not injecting fuel to deactivated cylinders when engine load is out of range, engine torque variation may be reduced to improve the engine torque signal to noise ratio.

At 1009, method 1000 judges whether or not the torque converter clutch is open and the torque converter is unlocked. If the torque converter is unlocked, the torque converter turbine and impeller may rotate at different speeds. The torque converter impeller and turbine speeds may be indicative of whether or not the driveline is passing through or being at a zero torque point. However, if the torque converter clutch is locked, the indication of the zero torque point may be less clear. The torque converter clutch state may be sensed or a bit in memory may indicate whether or not the torque converter clutch is open. If the torque converter clutch is unlocked, the answer is yes and method 1000 proceeds to 1010. Otherwise, the answer is no and method 1000 proceeds to 1014. Thus, in some examples, the torque converter clutch may be commanded open to unlock the torque converter when the determination of cylinder air-fuel ratio imbalance is desired.

At 1010, method 1000 determines an absolute value of a difference between torque converter impeller speed and torque converter turbine speed. The speed difference may be indicative of the engine transitioning through a zero torque point where engine torque is equivalent to driveline torque. During vehicle deceleration, engine torque may be reduced and vehicle inertia may transfer a negative torque from vehicle wheels into the vehicle driveline. Consequently, a space between vehicle gears referred to gear lash may increase to where the gears briefly fail to positively engage, and then the gears engage on an opposite side of the gears. The condition where there is a gap between gear teeth (e.g., gear teeth are not positively engaged) is the zero torque point. The increase in gear lash and subsequent reengagement of gear teeth may cause driveline torque disturbances which may induce engine torque determination errors. Therefore, it may be desirable to not inject fuel to select cylinders at the zero torque point during DFSO to reduce the possibility of skewing engine torque determination. Torque converter impeller speed being within a threshold speed of torque converter turbine speed (e.g., within ±25 RPM) may be indicative of being at or passing through the zero torque point where space between gears increases or lash develops. Therefore, fuel injection may be ceased until the driveline transitions through the zero torque point to avoid the possibility of inducing engine torque calculation errors. Alternatively, fuel injection may not be started until after the driveline passes through the zero torque point and gear teeth reengage during DFSO. Method 1000 proceeds to 1012 after the absolute value of the difference in turbine speed and impeller speed is determined.

At 1012, method 1000 judges if the absolute value of the difference in torque converter impeller speed and torque converter turbine speed is greater than a threshold (e.g., 50 RPM). If so, the answer is yes and method 1000 proceeds to 1014. Otherwise, the answer is no and method 1000 proceeds to 1016.

At 1014, method 1000 indicates that conditions for activating fuel injection to selected engine cylinders during DFSO to determine cylinder air-fuel imbalance via engine torque production are met. Consequently, one or more deactivated engine cylinders may be reactivated by injecting fuel into the select cylinders and combusting the fuel. Method 1000 indicates to the method of FIGS. 4-6 that conditions for injecting fuel to select deactivated cylinders during DFSO are present and exits.

At 1016, method 1000 indicates that conditions for activating fuel injection to selected engine cylinders during DFSO to determine cylinder air-fuel imbalance are not met. Consequently, one or more deactivated engine cylinders continue to be deactivated until conditions for injecting fuel to deactivated cylinders are present. Additionally, it should be noted that fueling of one or more cylinders may be stopped and then restarted in response to conditions for injecting fuel changing from being present to not being present then later being present. In some examples, analysis for cylinder imbalance starts over for cylinders receiving fuel so that the cylinder's torque is not averaged based on engine torque before and after conditions where fuel is not injected. Method 1000 indicates to the method of FIGS. 4-6 that conditions for injecting fuel to select deactivated cylinders during DFSO are not present and exits.

In this way, the open-loop air-fuel ratio control may be more consistent (e.g., replicated) from a first selected cylinder group to a second selected cylinder group. It will be appreciated by one skilled in the art that other suitable conditions and combinations thereof may be applied to begin fuel injection to cylinders deactivated during the DFSO event. For example, fuel injection may begin a predetermined amount of time after an exhaust air-fuel ratio is leaner than a threshold air-fuel ratio.

Note that the example control and estimation routines included herein can be used with various engine and/or vehicle system configurations. Further, the methods described herein may be a combination of actions taken by a controller in the physical world and instructions within the controller. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

during a deceleration fuel shut-off (DFSO) event where all engine cylinders are deactivated, selectively sequentially fueling and combusting air and fuel in cylinders of a cylinder group in an engine, and after termination of the DFSO event, adjusting fuel injected to one or more cylinders in the cylinder group in response to a difference between an engine torque measured during the DFSO event and an expected engine torque.

2. The method of claim 1, further comprising adjusting subsequent engine operation based on the difference.

3. The method of claim 2, where the cylinder group is selected based on one or more of a firing order and a cylinder position within the firing order.

4. The method of claim 2, where the fueling of the cylinder group occurs only after a maximum lean air-fuel ratio is measured during the DFSO event.

5. The method of claim 2, where adjusting subsequent engine operation includes adjusting a fuel injector pulse width in response to the difference.

6. The method of claim 1, where the cylinder group is fueled and operated to perform a combustion cycle a plurality of times during the DFSO event, producing a plurality of engine torque responses that are together used to identify an imbalance.

7. A method for an engine-driven vehicle, comprising:

after disabling all cylinders of an engine during a deceleration fuel shut-off (DFSO) event, in response to an air-fuel ratio of an exhaust gas output of the engine reaching a maximum lean air-fuel ratio, individually fueling one or more of the disabled cylinders to combust a lean air-fuel mixture; and after termination of the DFSO event, adjusting fuel injected to at least one of the individually fueled cylinders in response to a variation of engine torque produced via the combustion of the lean air-fuel mixture during the DFSO event from a base engine torque produced by the lean air-fuel mixture.

8. The method of claim 7, where the base engine torque is compensated for vehicle mass.

9. The method of claim 7, where the base engine torque is compensated for a grade of a road on which the vehicle is traveling.

10. The method of claim 7, where the base engine torque is compensated for a present active transmission gear.

11. The method of claim 7, further comprising not determining variation of engine torque from the base engine torque in response to a request to change a transmission gear.

12. The method of claim 7, where the lean air-fuel mixture is a predetermined air-fuel ratio from a lean air-fuel ratio combustion stability limit.

13. The method of claim 7, further comprising increasing an amount of fuel injected to the at least one of the individually fueled cylinders in response to less than a desired amount of torque being produced by the cylinder.

14. A method, comprising:

after disabling all cylinders of an engine during a deceleration fuel shut-off (DFSO) event, in response to an air-fuel ratio of an exhaust gas output of the engine reaching a maximum lean air-fuel ratio, delaying individually fueling one or more of the disabled cylinders to combust a lean air-fuel mixture in response to a driveline zero torque point; and after termination of the DFSO event, adjusting fuel injected to at least one of the individually fueled cylinders in response to a variation of engine torque produced by the combustion of the lean air-fuel mixture during the DFSO event from a base engine torque produced by the lean air-fuel mixture.

15. The method of claim 14, where the driveline zero torque point is based on torque converter impeller speed and torque converter turbine speed.

16. The method of claim 14, further comprising reactivating all engine cylinders in response to force applied to an accelerator pedal.

17. The method of claim 14, where all cylinders are disabled responsive to an engine load less than a threshold.

* * * * *